US005181025A

United States Patent [19]

Ferguson et al.

[11] Patent Number: 5,181,025

[45] Date of Patent: Jan. 19, 1993

[54] CONFORMAL TELEMETRY SYSTEM

[75] Inventors: Dennis D. Ferguson, St. Paul; Gary D. Havey, Maplewood, both of Minn.

[73] Assignee: The United States of America as represented by the Secretary of the Air Force, Washington, D.C.

[21] Appl. No.: 705,472

[22] Filed: May 24, 1991

[51] Int. Cl.[5] ..... G08C 19/16

[52] U.S. Cl. ..... 340/870.21; 343/700 MS; 455/98

[58] Field of Search ..... 343/700 MS, 702, 708; 340/870.21, 870.16, 825.54, 572; 455/95, 98, 127, 129; 235/488, 492, 382; 361/395

[56] References Cited

U.S. PATENT DOCUMENTS

| | | | |
|---|---|---|---|
| Re. 32,369 | 3/1987 | Stockton et al. | 342/368 |
| 3,717,857 | 2/1973 | Evans | 340/870.21 |
| 3,823,404 | 7/1974 | Buie, Jr. | 343/708 |
| 3,971,032 | 7/1976 | Munson et al. | 343/770 |
| 4,162,499 | 7/1979 | Jones, Jr. et al. | 343/708 |
| 4,218,682 | 8/1980 | Yu | 343/700 MS |
| 4,353,064 | 10/1982 | Stamm | 235/382 |
| 4,654,622 | 3/1987 | Foss et al. | 338/14 |
| 4,866,435 | 9/1989 | Frick | 340/870.16 |
| 4,920,353 | 4/1990 | Mori et al. | 343/702 |
| 5,023,624 | 6/1991 | Heckaman et al. | 343/700 MS |

*Primary Examiner*—Donald J. Yusko
*Assistant Examiner*—Robert Gray
*Attorney, Agent, or Firm*—Irwin P. Garfinkle; Donald J. Singer

[57] ABSTRACT

A conformal telemetry package comprises a complete system including sensors, data acquisition components, a controller, RF transmitter, antenna and battery. The package is approximate 0.1 inch thick and is flexible and capable of conformable mounting to a curved surface. This package includes a printed circuit antenna such as a microstrip patch antenna. The bottom of the package is coated with an adhesive permitting the system to be mounted on surfaces such as the leading edge of an air foil. The package is kept thin and flexible by using multiple layers of flexible dielectric such as Teflon and extremely high levels of circuit integration.

1 Claim, 1 Drawing Sheet

CONFORMAL TELEMETRY SYSTEM

STATEMENT OF GOVERNMENT INTEREST

The invention described herein may be manufactured and used by or for the Government for governmental purposes without the payment of any royalty thereon.

This invention relates to a conformal telemetry package comprising a complete telemetry system including sensors, data acquisition components, a controller, RF transmitter, antenna and battery in a very thin flexible package capable of conformable mounting to a curved surface. This package comprises an essentially planar printed circuit antenna such as a microstrip patch antenna. The bottom of the pack is coated with an adhesive permitting the system to be mounted on surfaces such as the leading edge of an air foil. Conformity to the surface where the sensor data is located is the result of the flexibility of the package and the package flexibility is a result of the package materials and the thinness of those materials.

The package is kept thin and flexible by using multiple layers of flexible dielectric such as Teflon TM and extremely high levels of circuit integration. The sensor is integrated with the data acquisition circuit and controller circuit onto an essentially planar integrated circuit. Typical sensors include temperature, voltage, current, light, pressure, magnetic, vibration, acceleration, air flow and others. The data acquisition systems converts the sensor data to digital form. The controller formats the digitized sensor data into a pulsed coded modulation format. Other formats can be generated. The transmitter consists of a voltage controlled VCO with an angle (FSK to PSK) modulation, and the power amplifier increases the signal level. The RF signal is transmitted by the printed circuit antenna to a remote location until the battery is exhausted. Battery life can be extended by compressing the data and transmitting with a low duty cycle.

The conformal telemetry system is mounted in the area where sensor data is required by peeling away a protective skin and exposing an adhesive, and then placing it on the area to which it conforms.

The conformal telemetry system provides several advantages over existing systems. It provides sensor data in areas which currently cannot be instrumented such as the surface of a wing or the surface of a munition. It is fabricated from low cost materials and is disposable. Due to its low cost, it promotes distributed sensor systems.

BACKGROUND OF THE INVENTION

A typical telemetry system consists of a telemetry module, which transmits the measured performance data of a submunition in flight to a ground based receiver. Sensors connected to the telemetry module measure parameters such as temperature, acceleration, rate of spin and altitude. The ground based receiver collects the transmitted data from the telemetry module, decodes it, and prints it out for analysis after the test has been performed.

The inputs to the module come from integrated sensors located within the module. The data formatter combines the input data from the sensors into a pulse-coded stream of signals for input to the transmitter. If several different data channels are required, the data formatter will multiplex the sensor data. The data formatter also converts analog inputs to their digital signal equivalent.

BRIEF DESCRIPTION OF THE DRAWINGS

For a better understanding of the nature of the invention, reference should now be made to the following description, and to the accompanying drawings in which.

DESCRIPTION OF THE PREFERRED EMBODIMENT

Figure 2:
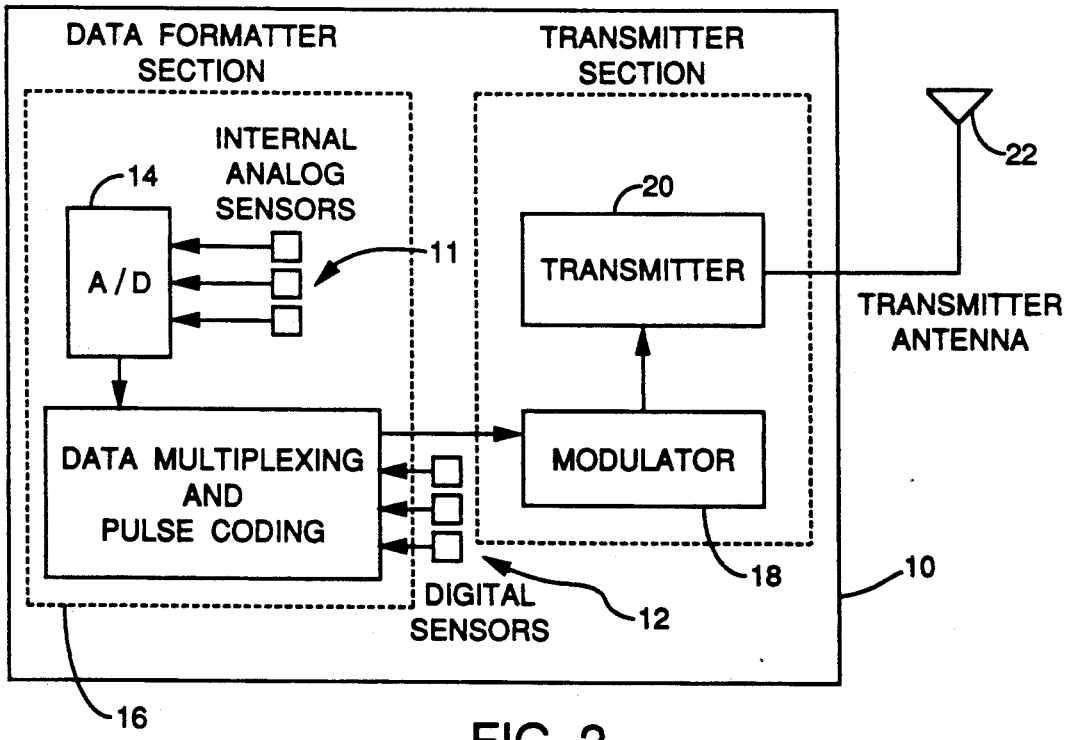
FIG. 2 is a block diagram of the exemplary telemetry system circuitry embodied in the structure of FIG. 1.

Referring first to FIG. 2, the telemetry system 10 includes a plurality of analog sensors 11, and a plurality of digital sensors 12. The type and number of sensors incorporated in an actual system will depend on the type of data which is being sensed and on the requirements of the system. The analog data signals are converted to digital in an Analog to Digital converter 14. The digital output from the converter 14, and the digital output of each of the digital sensors 12 are applied to data multiplexing and pulse coding circuitry 16. The output from the multiplexing and pulse coding circuitry 16 is applied to modulator 18 which modulates the output of an R.F. transmitter 20. The modulated R.F. signal is transmitted to a remote receiver (not shown) by means of an antenna 22. All of the elements including the antenna and a battery (not shown in FIG. 2) are housed in a conformal package, and adhered to a surface, such as airfoil concerning which data is to be taken.

Figure 1:
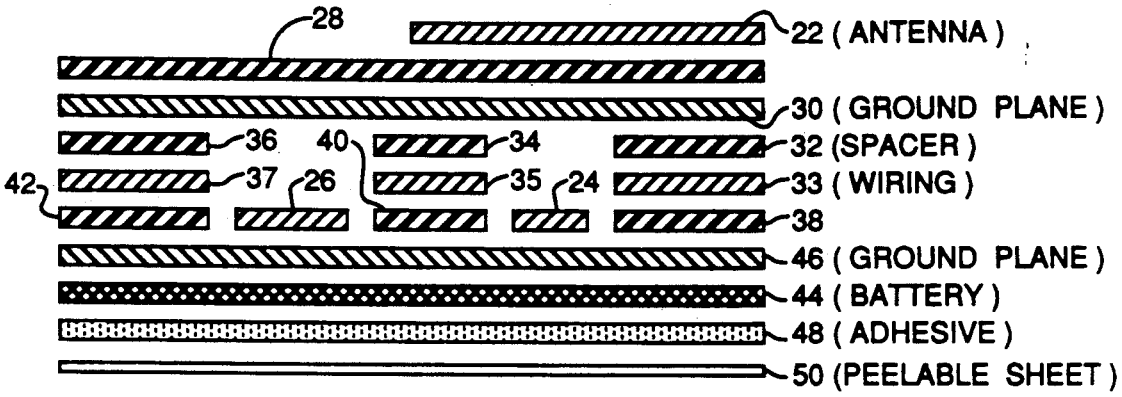
FIG. 1 is a diagrammatic illustration of a preferred embodiment of this invention.

Referring now to FIG. 1, the system 10, which includes the sensors 11 and 12, the analog to digital converter 14, the data multiplexing and pulse coding system 15, the modulator 18 and the transmitter 20 are incorporated into a plurality of planar microminiaturized integrated circuit (MMIC) chips 24 and 26.

The conformal package illustrated in FIG. 2 is shown greatly enlarged and broken apart. In actual practice it measures approximately 0.1 inches in thickness and is about the size of a conventional credit card.

On the top surface of the conformal package is a planar printed circuit antenna 22 such as a microstrip patch antenna. In submunition applications, antennas must have very thin profiles to avoid being ripped off, initially by hot gases as the submunition is launched, and then by air as the submunition flies throughout its mission The profile of antenna 22 is maintained very thin by applying a microstrip patch antenna to the package with a very thin, layer of adhesive 28, such as 3M type A30, which provides an insulating spacer for the antenna 22 from its copper ground plane 30. The next layer of the package comprises dielectric spacers 32, 34, and 36 which serve to insulate copper wiring 33, 35, and 37. The dielectric spacers are very thin, flexible materials such as teflon. The copper wiring is deposited on dielectric spacers 38, 40 and 42 and serves (in a conventional manner not shown) to connect the various elements in the circuits 24 and 26, the antenna 22, and a battery 44. The battery 44 may comprise a Powerdex TM battery used in the Polaroid TM camera film pack. It has a lithium chemistry for high power and a wide temperature range. It is constructed in a thin flat profile so that it is particularly suited for peel-and-stick applications. The spacers 38, 40 and 42 are applied to a copper ground plane 46. The entire package may then be applied to a submunition or other device under test by means of an adhesive 48 such as 3M type A30. A peelable plastic sheet 50 covers the adhesive until just prior to mounting on the device under test.

It will be understood by persons skilled in the art that this invention is subject to various modifications and adaptations. It is intended, therefore, that the scope of the invention be limited only by the following claims as interpreted in the light of the specification and the appended claims.

What is claimed is:

1. A thin, flexible, conformal package for a telemetry system for sensing and transmitting data relative to a device under test, thickness of said entire package being less than one-eighth inch and being flexibly conformable to a curved surface, said package comprising:

an essentially planar, flexible microstrip patch printed circuit antenna a very thin copper ground plane for said antenna, said antenna being insulatedly spaced from and adhered to said ground plane by an adhesive dielectric coating;

a telemetering circuit intended when energized for supplying RF signals to said antenna for transmission to a remote location, said telemetering circuit including sensors, data acquisition components, a controller, and RF transmitter integrated into an essentially planar printed circuit, the upper and lower planar surfaces of said circuit being insulated with a thin film of dielectric material;

a plurality of sensors, said sensors and said telemetering circuit being integrated onto a planar, printed, integrated circuit layer;

a thin, flat battery adhered to said layer;

a metallic ground plane between said layer and said battery;

dielectric spacers between said ground plane and said layer;

an adhesive on said battery for adhering said system to a device to be tested; and a peelable plastic sheet protecting the adhesive on said battery prior to adhering said battery to said device.

* * * * *